US008761342B2

(12) United States Patent
Behling

(10) Patent No.: US 8,761,342 B2
(45) Date of Patent: Jun. 24, 2014

(54) COMPENSATION OF ANODE WOBBLE FOR X-RAY TUBES OF THE ROTARY-ANODE TYPE

(75) Inventor: Rolf Karl Otto Behling, Norderstedt (DE)

(73) Assignee: Koninklijke Philips N.V., Eindhoven (NL)

( * ) Notice: Subject to any disclaimer, the term of this patent is extended or adjusted under 35 U.S.C. 154(b) by 344 days.

(21) Appl. No.: 13/131,883

(22) PCT Filed: Dec. 1, 2009

(86) PCT No.: PCT/IB2009/055436
§ 371 (c)(1),
(2), (4) Date: May 31, 2011

(87) PCT Pub. No.: WO2010/067260
PCT Pub. Date: Jun. 17, 2010

(65) Prior Publication Data

US 2011/0235784 A1 Sep. 29, 2011

(30) Foreign Application Priority Data

Dec. 8, 2008 (EP) ..... 08170899

(51) Int. Cl.
*H01J 35/30* (2006.01)

(52) U.S. Cl.
USPC ..... 378/137; 378/205; 378/207

(58) Field of Classification Search
USPC ..... 378/137, 145, 162, 204, 205, 207
See application file for complete search history.

(56) References Cited

U.S. PATENT DOCUMENTS

| | | | | |
|---|---|---|---|---|
| 4,442,539 | A * | 4/1984 | Aichinger et al. | 378/207 |
| 5,469,429 | A | 11/1995 | Yamazaki et al. | |
| 5,550,889 | A * | 8/1996 | Gard et al. | 378/113 |
| 2002/0168053 | A1 | 11/2002 | Schomberg | |
| 2005/0243969 | A1 | 11/2005 | Andrews | |
| 2006/0093092 | A1 | 5/2006 | Kuhn | |
| 2008/0043916 | A1 | 2/2008 | Lemaitre | |

FOREIGN PATENT DOCUMENTS

| | | | |
|---|---|---|---|
| DE | 19611228 | C1 | 3/1996 |
| DE | 19810346 | C1 | 3/1998 |
| WO | 2007129244 | A2 | 11/2007 |

* cited by examiner

*Primary Examiner* — Jurie Yun

(57) ABSTRACT

For X-ray tubes of the rotary-anode type for generating a fan beam of X-rays, compensation is afforded for system-related disturbances of the focal spot position on a target area of the rotating anode, and particularly for the anode wobble in an X-ray tube, which occurs as a periodically wobbling inclination angle of the anode disk's rotational plane with respect to an ideal rotational plane, the latter being oriented normal to the rotational axis of the rotary shaft on which the anode disk is inclinedly mounted due to an inaccuracy during its production process. For this purpose, the electron beam generated by a thermionic or other type of electron emitter of the tube's cathode and thus the focal spot position on a target area of the anode disk's X-ray generating surface are steered such that the focal spot stays within the plane of the central X-ray fan beam.

24 Claims, 6 Drawing Sheets

COMPENSATION OF ANODE WOBBLE FOR X-RAY TUBES OF THE ROTARY-ANODE TYPE

FIELD OF THE INVENTION

The present invention refers to X-ray tubes of the rotary-anode type for generating a fan beam of X-rays. More particularly, the invention is concerned with a system and method for compensating a class of system-related disturbances of the focal spot position on a target area of the rotating anode and particularly for compensating the anode wobble in an X-ray tube of the aforementioned type, which occurs as a periodically wobbling inclination angle of the anode disk's rotational plane with respect to an ideal rotational plane which is oriented normal to the rotational axis of the rotary shaft on which the anode disk is inclinedly mounted due to an inaccuracy during its production process. For this purpose, the electron beam generated by a thermoionic or other type of electron emitter of the tube's cathode and thus the focal spot position on a target area of the anode disk's X-ray generating surface (anode target) are steered such that the focal spot stays within the plane of the central X-ray fan beam.

BACKGROUND OF THE INVENTION

Conventional X-ray tubes for high-power operation typically comprise an evacuated chamber (tube envelope) which holds a cathode filament through which a heating or filament current is passed. A high voltage potential, usually in the order between 40 kV and 160 kV, is applied between an electron emitting cathode and the tube anode. This voltage potential causes the electrons emitted by the cathode to be accelerated in the direction of the anode. The emitted electron beam then impinges on a small area (focal spot) on the anode surface with sufficient kinetic energy to generate X-ray beams consisting of high-energetic photons, which can then e.g. be used for medical imaging or material analysis.

X-ray tubes of the rotary-anode type were first built in the 1930s. Compared to stationary anodes, a rotating anode offers the advantage of being able to distribute the thermal energy that is deposited onto the anode target's focal spot across the larger surface of a focal ring (also referred to as "focal track"). This permits an increase in power for short operation times. However, as the anode disk is now rotating in a vacuum, the transfer of thermal energy to the outside of the tube envelope is not as effective as the liquid cooling used in stationary anodes. Rotating anodes are thus designed for high heat storage capacity beneath the focal track and for good radiation exchange between the anode disk and the tube envelope. A minimum diameter of the anode disk of between 80 and 240 mm is needed, which gives rise to a slight wobble of up to approximately 0.05 mm. This is significant in relation to an optical focal spot size of down to 0.15 mm (in a projected view as seen from the X-ray detector of an X-ray system which comprises said X-ray tube).

SUMMARY OF THE INVENTION

In conventional X-ray tubes of the rotary-anode type which are available on the market today, the rotating anode is never mounted straight on the anode shaft due to mechanical tolerances and inaccuracies during the production process. Therefore, some wobble effect is usually experienced which leads to a periodic position change of the focal spot on the anode target. As a result thereof, the focal spot may be blurred. It is thus an object of the present invention to overcome this problem.

In view of this object, a first exemplary embodiment of the present application refers to a system for measuring and compensating a recurrent deviation of the actual position from the desired position of an electron beam's focal spot, said electron beam being emitted by an electron emitter of the X-ray tube's cathode on a target area of an X-ray tube's rotary anode disk, wherein said system comprises a position sensor for detecting the recurrent deviation during at least one period thereof, a beam deflection unit with an integrated controller for deflecting said electron beam based on the measurement results obtained from the position sensor.

According to a preferred aspect of this embodiment, said system may especially be adapted for measuring and compensating a periodical wobbling of the inclination angle of an X-ray tube's rotary anode disk with respect to an ideal rotational plane which is oriented normal to a rotating shaft on which the rotary anode disk is inclinedly mounted due to an inaccuracy during its production process, wherein said position sensor is adapted for detecting deviations of said inclination angle over the time.

According to the proposed invention, it may especially be provided that said position sensor comprises position sensing means for detecting the deviation amplitude by which the position of the focal spot is deviated in the direction of the rotational axis of the rotary anode disk's rotating shaft. In this connection, said position sensor may be implemented as a capacitive or optical sensor which provides information for deriving the deviation amplitude of the focal spot. As an alternative thereto, said position sensor may also be implemented as a current sensor for measuring the number of scattered electrons flying through an aperture slit of said sensor from which number the deviation amplitude of the focal spot is then derivable. According to a third alternative, said position sensor may be configured to derive said deviation amplitude by comparing each X-ray image generated by an X-ray system to which said X-ray tube belongs with at least one camera image of a fixedly mounted camera from which the deviation amplitude of the focal spot can be taken.

The integrated controller of the beam deflection unit may preferably be configured to steer said electron beam such that the electron beam's focal spot in a target region on an X-ray generating surface of the rotary anode disk stays within the plane of the central X-ray fan beam, wherein said plane is given by a plane which is substantially normal to the rotational axis of the rotating shaft in which the time-averaged position of the focal spot lies.

For example, the integrated controller of the beam deflection unit may be configured to steer said electron beam such that the electron beam's focal spot track describes an elliptical trajectory. According to an alternative thereof, said controller may be configured to steer said electron beam such that the focal spot track of said electron beam describes a predefinable trajectory so as to compensate for stand vibrations and anode disk bending effects aside from compensating for the periodical wobbling of the rotary anode disk's inclination angle.

In a similar fashion of compensating components of the focal spot position which are directed substantially perpendicular to the anode disk surface (and thus substantially parallel to the symmetry axis z of the anode's rotating shaft), also those components of disturbances of the focal spot position can be compensated which are directed tangential (i.e. in oriented in azimuth directions) to the anode disk by measuring these components and deflecting the electron beam in the respective tangential direction.

A second exemplary embodiment of the present application is directed to an X-ray tube of the rotary-anode type which comprises a system as described above with reference to said first exemplary embodiment.

A third exemplary embodiment of the present application relates to a method for measuring and compensating a recurrent deviation of the actual position from the desired position of an electron beam's focal spot, said electron beam being emitted by an electron emitter of the X-ray tube's cathode on a target area of an X-ray tube's rotary anode disk, wherein said method comprises the steps of detecting the recurrent deviation during at least one period thereof and deflecting said electron beam based on the measurement results obtained from the measurement step.

According to a preferred aspect of this embodiment, said method may be adapted for measuring and compensating a periodical wobbling of the inclination angle of an X-ray tube's rotary anode disk with respect to an ideal rotational plane which is oriented normal to a rotating shaft on which the rotary anode disk is inclinedly mounted due to an inaccuracy during its production process, wherein said detection step is adapted for detecting deviations of said inclination angle over the time.

Preferably, said electron beam may be steered such that the electron beam's focal spot in a target region on an X-ray generating surface of the rotary anode disk stays within the plane of the central X-ray fan beam, wherein said plane is given by a plane which is substantially normal to the rotational axis of the rotating shaft in which the time-averaged position of the focal spot lies.

The electron beam may thereby be steered such that the electron beam's focal spot track describes an elliptical trajectory. Alternatively, said electron beam may be steered such that the electron beam's focal spot track describes a predefinable trajectory so as to compensate for stand vibrations and anode disk bending effects aside from compensating for the periodical wobbling of the rotary anode disk's inclination angle.

According to the present invention, it may further be provided that said measurement step is executed during the production process of a system for performing said method and optionally repeated during the process of operation to allow for a re-calibration of said system. In said measurement step, the amplitude by which the position of the focal spot is deviated in the direction of the rotating anode shaft's rotational axis may thereby be detected by an anode phase resolved focal spot position measurement for various thermal conditions which may have an influence on the wobble effect.

Finally, a fourth exemplary embodiment of the present application refers to a software program product for executing a method as described with reference to said third exemplary embodiment when running on a processing unit of a system as described with reference to said first exemplary embodiment.

BRIEF DESCRIPTION OF THE DRAWINGS

These and other advantageous aspects of the invention will be elucidated by way of example with respect to the embodiments described hereinafter and with respect to the accompanying drawings. Therein.

DETAILED DESCRIPTION OF THE PRESENT INVENTION

In the following, the problems to be solved as well as the preferred embodiment of the present invention will be explained in more detail and with reference to the accompanying drawings.

Figure 1A:
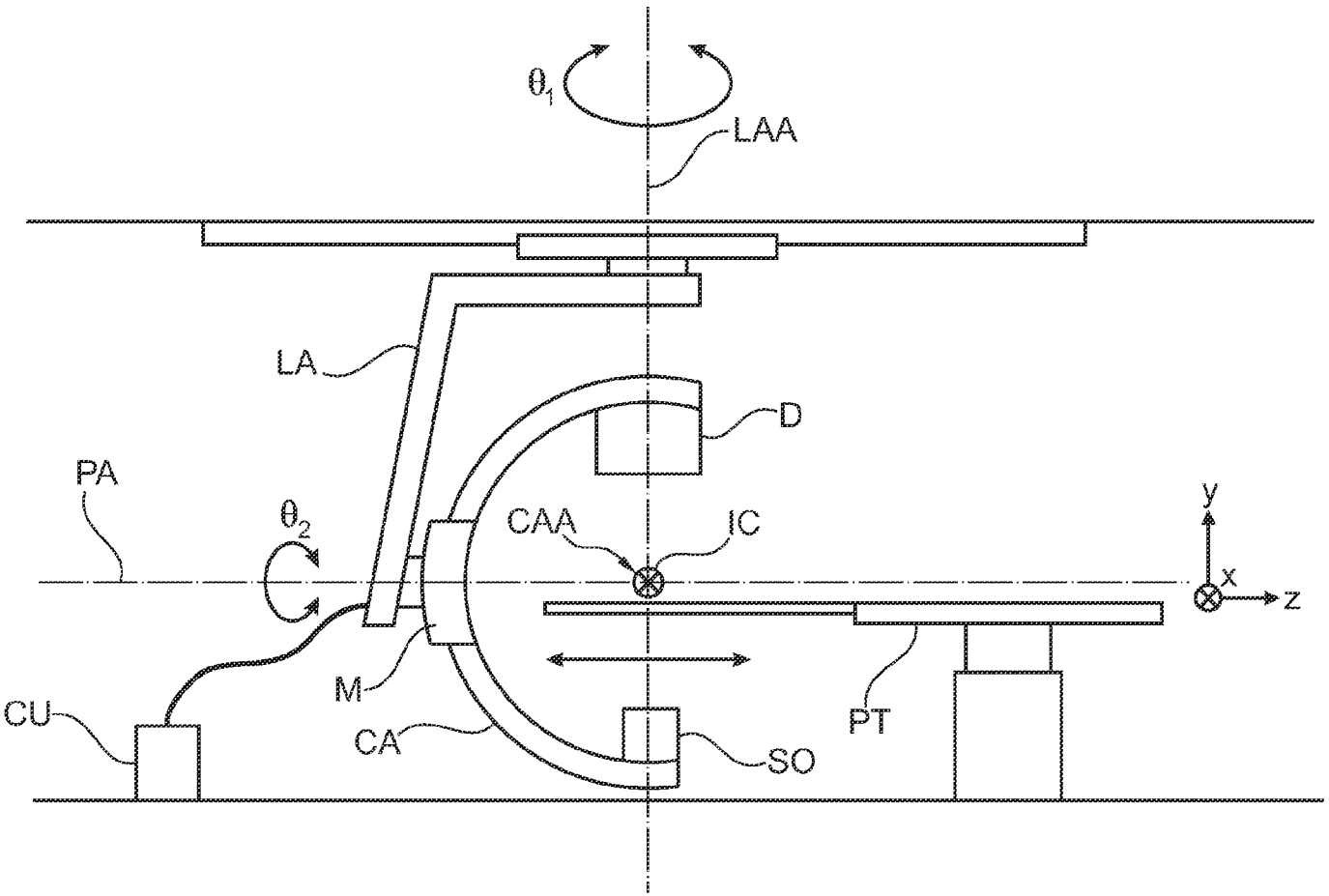
Fig. 1a (Prior Art)
FIG. 1*a* shows a conventional setup configuration of a mobile C-arm based rotational X-ray scanner system for use in tomographic X-ray imaging as known from the prior art.

In FIG. 1*a*, a conventional setup configuration of a mobile C-arm based rotational X-ray scanner system for use in tomographic X-ray imaging as known from the relevant prior art (e.g. such as disclosed in US 2002/0168053 A1) is shown. The depicted CT system comprises an X-ray source SO and an X-ray detector D arranged at opposite ends of a C-arm CA which is journally mounted so as to be rotatable about a horizontal propeller axis PA and a horizontal C-arm axis CAA perpendicular to said propeller axis by means of a C-arm mount M, thus allowing said X-ray source and X-ray detector to rotate by a rotational angle ($\theta_1$ or $\theta_2$, respectively) about the y- and/or z-axis of a stationary 3D Cartesian coordinate system spanned by the orthogonal coordinate axes x, y and z, wherein the x-axis has the direction of C-arm axis CAA, the y-axis is a vertical axis normal to the plane of the patient table (z-x-plane) and the z-axis has the direction of propeller axis PA. C-arm axis CAA, which points in a direction normal to the plane of drawing (y-z-plane), thereby passes through the isocenter IC of the C-arm assembly. A straight connection line between the focal spot position of X-ray source SO and the center position of X-ray detector D intersects propeller axis PA and C-arm axis CAA at the coordinates of isocenter IC. C-arm CA is journaled, by way of an L-arm LA, so as to be rotatable about an L-arm axis LAA which has the direction of the y-axis and intersects propeller axis PA and C-arm axis CAA at the coordinates of isocenter IC. A control unit CU is provided for continuously controlling the operation of at least two motors that are used for moving X-ray source SO and X-ray detector D along a specified trajectory around an object of interest which is placed in the area of isocenter IC within a spherical orbit (examination range) covered by C-arm CA when rotating about L-arm axis LAA or propeller axis PA. From FIG. 1*a* it can easily be taken that C-arm CA with X-ray detector D and X-ray source SO can be rotated about C-arm axis CAA while at the same time the C-arm mount M is rotated about the propeller axis PA and projection images of an object of interest to be examined are acquired.

Figure 1B:
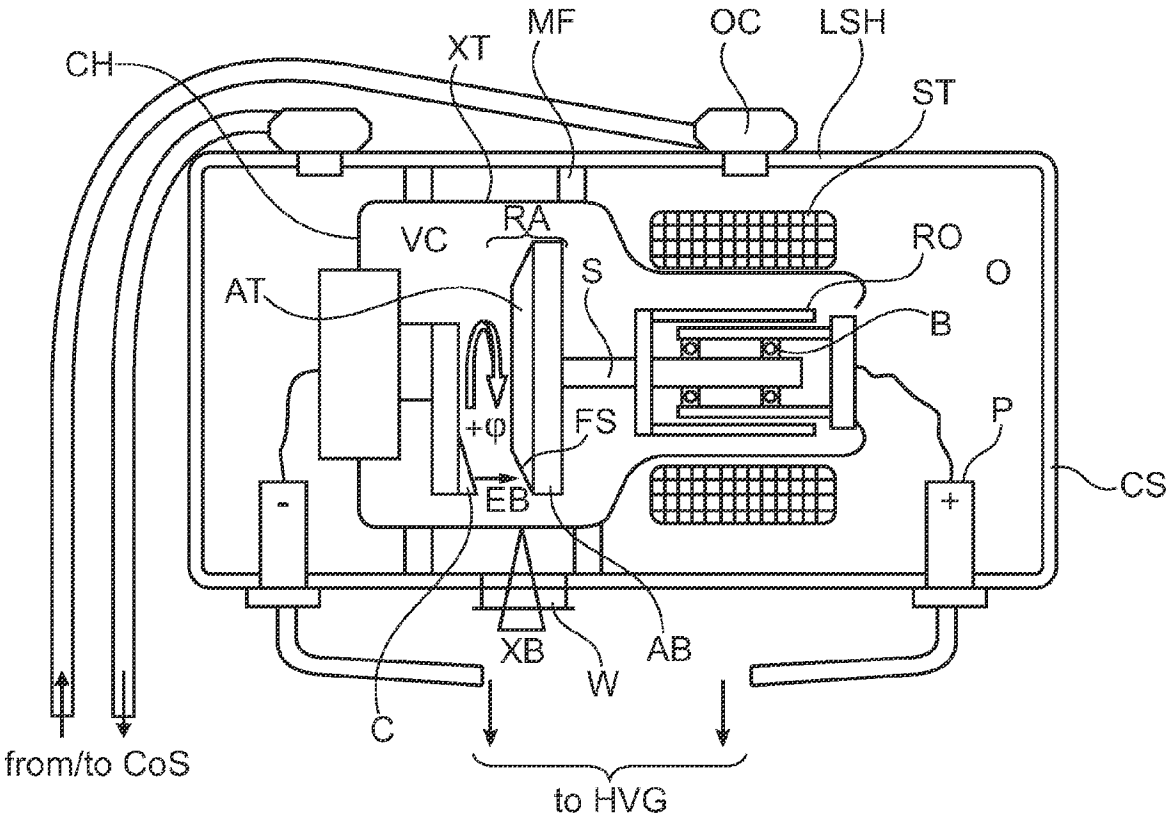
Fig. 1b (Prior Art)
FIG. 1*b* shows a cross-sectional schematic view of a conventional X-ray tube of the rotary-anode type as known from the prior art, which may be used as an X-ray source of the C-arm based rotational X-ray scanner system in FIG. 1*a*, FIG. 2*a* exemplarily shows two phases of rotation (wobble states) of a conventional X-ray tube's rotary anode inclinedly mounted on its anode shaft in a cross-sectional schematic view, said phases being shifted by a rotational angle of 180° against each other and characterized by different inclination angles of the rotating anode disk with respect to the rotational plane of the rotary anode, which illustrates that the focal spot position of an electron beam impinging on a conically inclined target area on the anode disk's X-ray emitting surface continuously changes with the phase of rotation owing to said wobble effect.

A schematic cross-sectional view of a conventional X-ray tube of the rotary-anode type as known from the prior art is shown in FIG. 1*b*. The X-ray tube comprises a stationary cathode C and a rotationally supported anode target AT fixedly attached to a rotary shaft S within an evacuated chamber CH given by a glass or metal-glass envelope. When being exposed to an electron beam EB of sufficient energy incident on a focal track region on an inclined surface of the anode target, said electrons being ejected from the anode target material due to a high voltage applied between the cathode and said anode, a conical X-ray beam XB is generated by the rotational anode target AT and emitted through a window W of a casing CS which contains the evacuated chamber.

Figure 2A:
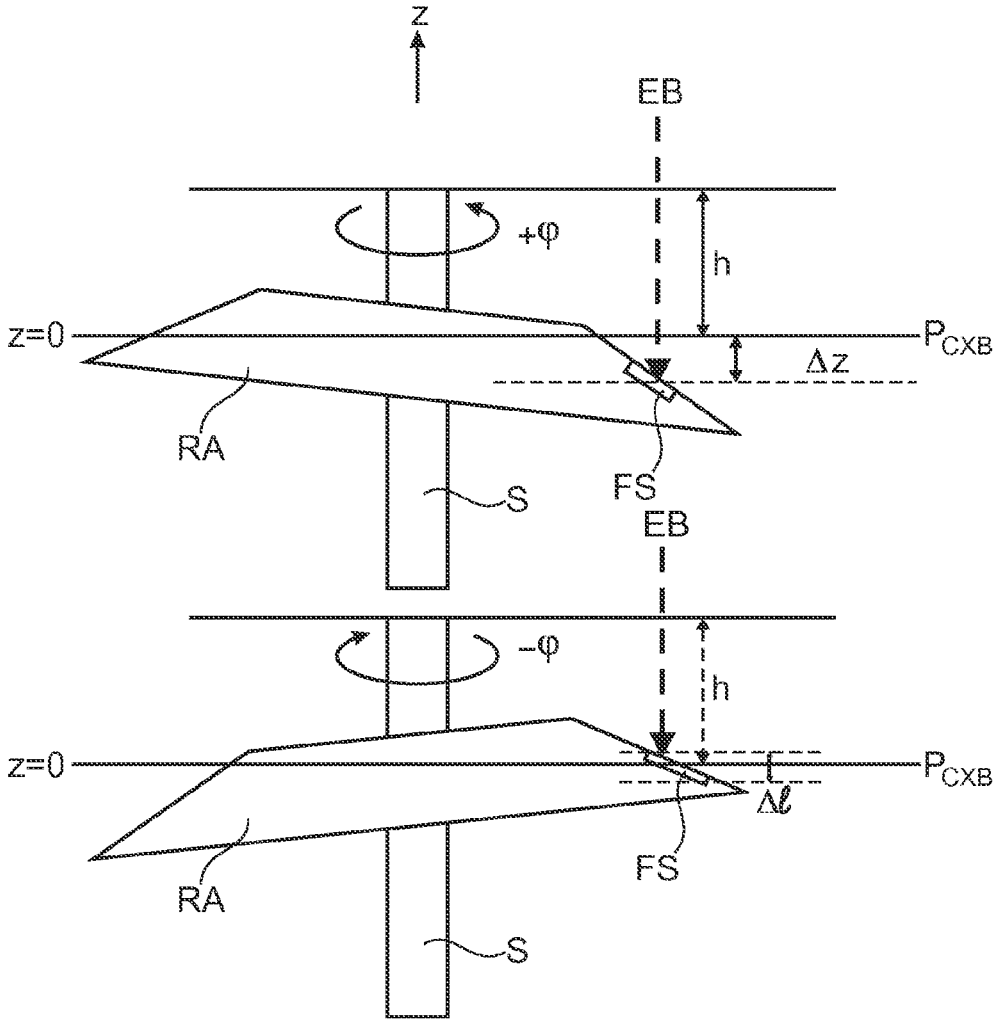
Fig. 2a (Prior Art)
FIG. 2*b* shows a cross-sectional schematic view of the inclinedly mounted rotary anode from FIG. 2*a* depicted in a first phase of rotation where the anode disk is inclined to the left with respect to the rotational plane of the rotary anode such that the focal spot position of the electron beam impinging onto the target area of the anode disk's X-ray emitting surface lies in the plane of the central X-ray fan beam.
FIG. 2*c* shows a cross-sectional schematic view of the inclinedly mounted rotary anode from FIG. 2*a* depicted in a second phase of rotation, obtained after one half revolution of the rotating anode disk about the rotational axis of its rotary shaft or an odd-valued multiple thereof, which illustrates that the anode disk is inclined to the right with respect to the rotational plane of the rotary anode such that the focal spot position of the electron beam impinging onto the target area of the anode disk's X-ray emitting surface does no longer lie in the plane of the central X-ray fan beam.

As already explained above, the rotating anode is never mounted straight on the anode shaft due to mechanical tolerances and inaccuracies during the production process. Therefore, some wobble effect is usually experienced which leads to a periodic position change of the focal spot on the anode target such that the focal spot may be blurred. FIG. 2*a* exemplarily shows two distinct phases of rotation of a conventional X-ray tube's rotary anode RA inclinedly mounted on its rotating anode shaft S in a cross-sectional schematic view. As depicted in this drawing, these phases of rotation, which are shifted by a rotational angle of 180° against each other, are characterized by different inclination angles of the rotating anode disk RA with respect to the rotational plane of the rotary anode. FIG. 2*a* thereby illustrates that the focal spot position FS of an electron beam EB impinging on a conically inclined target area AT on the anode disk's X-ray emitting surface continuously changes with the phase of rotation owing to said wobble effect. In case the radial size of the focal spot FS is small, the absolute value of the wobble amplitude is at least a significant fraction of it (particularly with large anode disks), and the exposure time is in the range of the anode rotation period or longer. As a consequence, the focal spot FS is blurred such that either the obtained image quality suffers or the power rating and electron beam's optical size (which means the diameter of focal spot FS) have to be reduced accordingly to let the size of the time-averaged focal spot FS stay within predefined design limits.

Figure 2B:
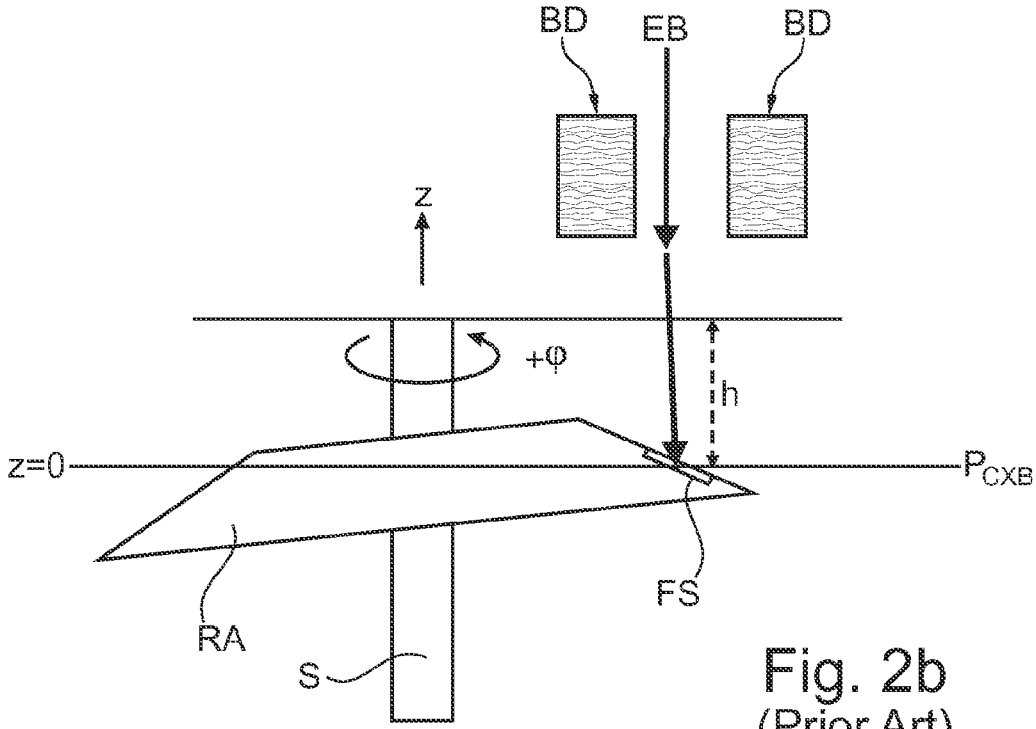
Fig. 2b (Prior Art)
Figure 2C:
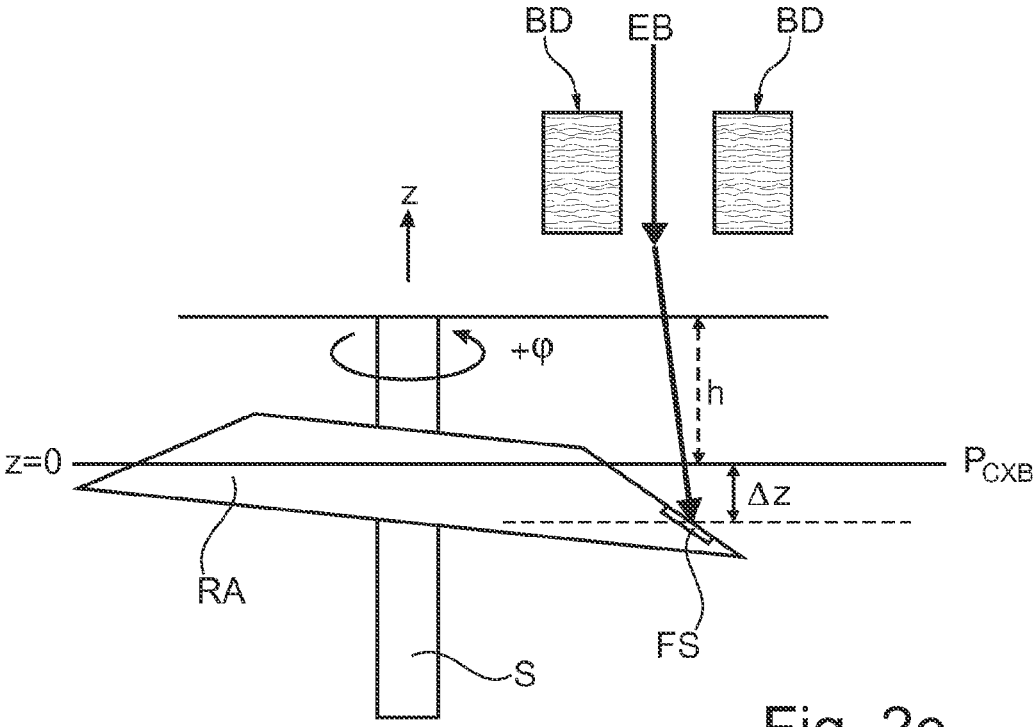
Fig. 2c (Prior Art)

In FIG. 2*b*, the cross-sectional schematic view of the inclinedly mounted rotary anode RA shown in FIG. 2*a* is depicted in a first phase of rotation (also referred to as "first wobble state") at a rotational angle of $\phi=\phi_0$(with $\phi_0 \in [0°; 360°[$) where the anode disk is inclined to the left with respect to the rotational plane of the rotary anode RA such that the focal spot FS of the electron beam EB impinging onto the target area AT of the anode disk's X-ray emitting surface lies in the plane $P_{CXB}$ of the central X-ray fan beam CXB, the latter being given by a plane which is substantially normal to the rotational axis of the anode's rotating shaft S in which the time-averaged position of the focal spot FS lies. Ideally, $P_{CXB}$ can be described by the Hessian normal form z=0 of the anode disk's rotational plane. In contrast thereto, FIG. 2*c* shows a cross-sectional schematic view of the inclinedly mounted rotary anode RA from FIG. 2*a* depicted in a second phase of rotation ("second wobble state") at a rotational angle of $\phi=\phi_0+(2k+1)\cdot 180°$ (with $k \in /$), which means after one half revolution of the rotating anode disk RA about the rotational axis of its rotary shaft S or an odd-valued multiple thereof. In this figure, the anode disk RA is inclined to the right with respect to the rotational plane of the rotary anode such that the focal spot position FS of the electron beam EB impinging onto the target area AT of the anode disk's X-ray emitting surface does no longer lie in the plane $P_{CXB}$ of the central X-ray fan beam CXB.

If the rotary anode disk RA is rotated by 180° in +ϕ- or -ϕ-direction from the situation depicted in FIG. 2*b* to the situation depicted in FIG. 2*c*, the position of the focal spot FS on the X-ray emitting surface of the anode target AT is deviated by a deviation amplitude Δz in -z-direction with z describing the direction of the anode shaft's rotational axis. Vice versa, if the anode disk RA is rotated by 180° in +ϕ- or -ϕ-direction from the situation depicted in FIG. 2*c* to the situation depicted in FIG. 2*b*, the position of the focal spot FS on the X-ray emitting surface of the anode target AT is deviated by Δz in +z-direction. This is because the rotary anode is inclinedly mounted to the anode disk's rotational plane (the latter being oriented normal to the axis of rotation z of the rotary anode shaft S), and the electron beam EB is usually parallel to this axis of rotation.

The deviation amplitude Δz may thereby range between 30 μm (in case of a new tube) and some hundred micrometers (in case of a used tube). If Δz reaches a significant fraction of the projected focal spot diameter Δl, which is perspectively foreshortened in z-direction such as seen from a point of view which lies in the plane $P_{CXB}$ of the central X-ray beam CXB on the right side of the anode disk RA depicted in FIG. 2*a*, and if the X-ray pulse length is in the order of half the anode rotation period or longer, the X-ray image is blurred. To avoid this blurring effect, the focal spot size has to be reduced, which results in a reduced power rating.

According to the present invention, said wobble effect is compensated by radial deflection of the electron beam EB generated by a thermoionic or other type of electron emitter of the tube's cathode C before impinging on the target area AT of the rotary anode disk. For this purpose, said electron beam EB is steered such that the position of its focal spot FS, which is located on the X-ray generating (usually conically inclined) surface of the anode target AT, stays within the plane $P_{CXB}$ of the central X-ray fan beam CXB. This typically results in an elliptical trajectory shape of the focal spot track. However, the electron beam EB can also be steered in such a way that it follows any other focal track trajectory so as to compensate for any other mechanical distortions aside from the periodic wobble effect caused by the continuously varying inclination angle of the inclinedly mounted rotating anode disk RA.

Figure 3A:
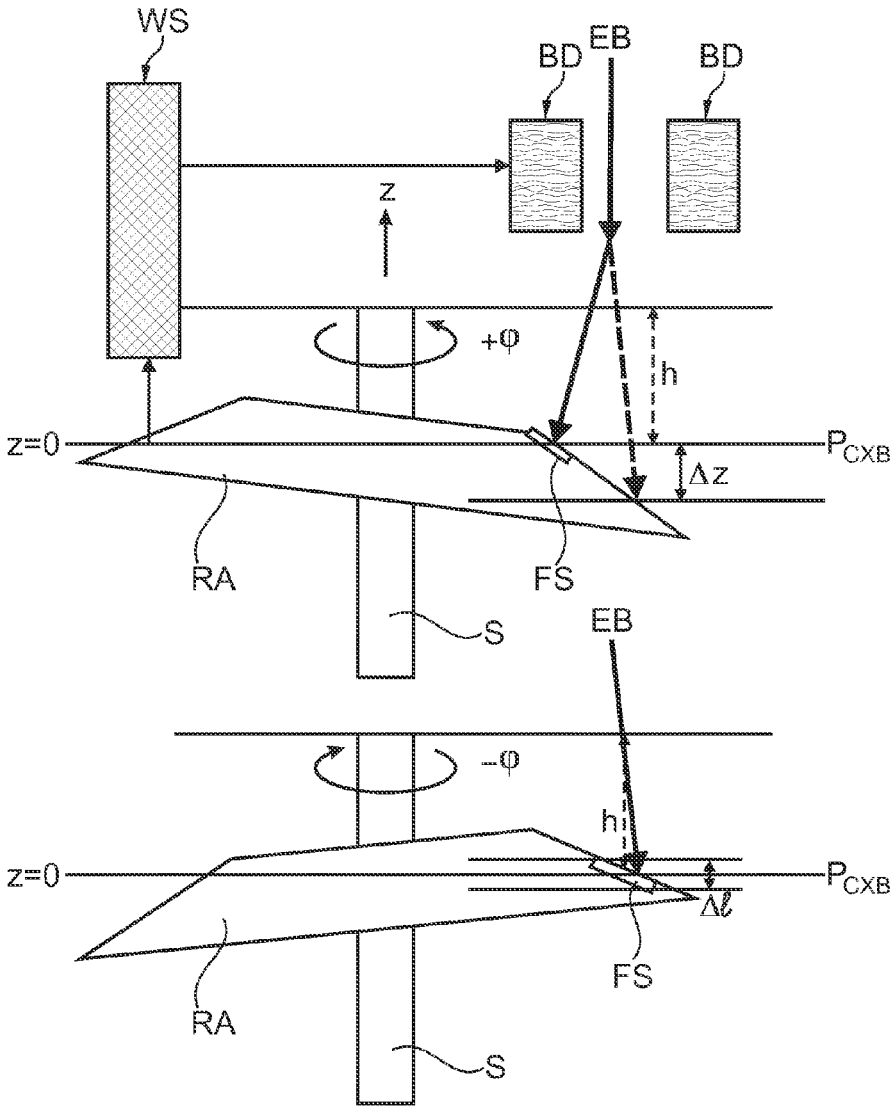
FIG. 3*a* shows a system for measuring and compensating the periodical wobbling of the anode disk's inclination angle with respect to its rotational plane, exemplarily illustrated for the two aforementioned phases of rotation of the conventional X-ray tube's inclinedly mounted rotary anode as depicted in FIG. 2*a*.

As depicted in FIG. 3*a*, the present invention thereby provides a system for measuring and compensating the periodical wobbling of the anode disk's inclination angle with respect to its rotational plane (the latter being oriented normal to the rotational axis of the rotating shaft S), which is exemplarily illustrated for the two aforementioned phases of rotation of the conventional X-ray tube's inclinedly mounted rotary anode as depicted in FIG. 2*a*. Said measurement, which may be executed by a position sensor WS during the production process and (optionally) repeated during operation process of X-ray tube XT, may thereby be realized as an anode phase resolved focal spot position measurement for various thermal conditions which may have an influence on the distorting wobble effect (e.g. through anode disk bending). Based upon this measurement, control data which are derived from the measurement results of said position sensor WS are supplied to an integrated beam deflection unit BD of said X-ray tube XT, wherein said beam deflection unit is used to accordingly steer the electron beam EB emitted by the tube cathode's thermoionic or other type of electron emitter. During operation, said measurement may then be repeated so as to re-calibrate the system. Aside from the above-described wobble effect, other system-related distortions (such as e.g. stand vibrations and anode disk bending) can also at least partly be compensated by applying the claimed system and method.

Figure 3B:
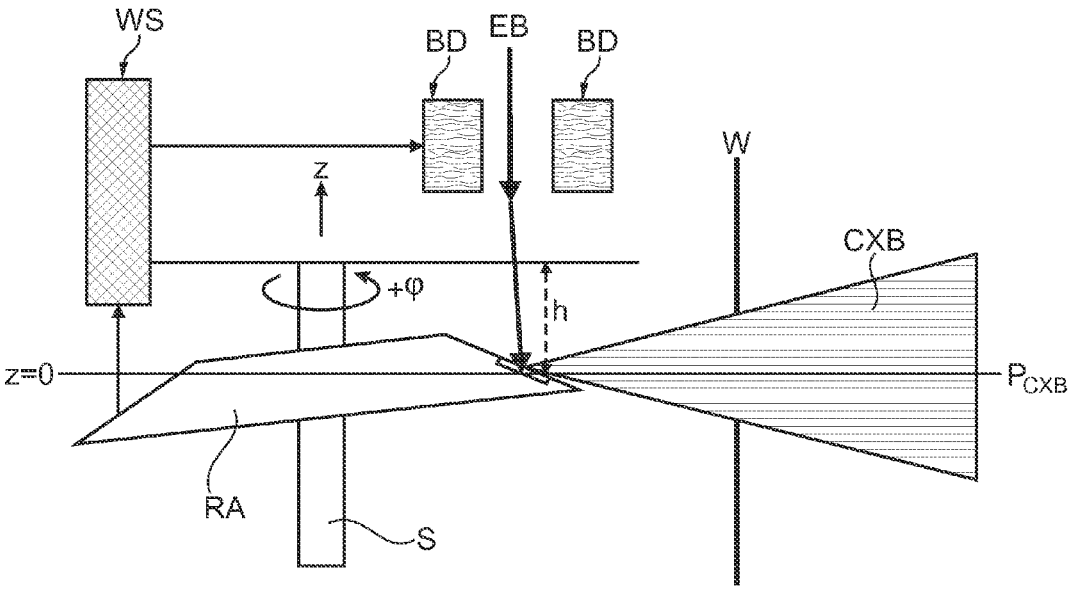
FIG. 3*b* shows a cross-sectional schematic view of the inclinedly mounted rotary anode from FIG. 3*a* depicted in the first phase of rotation where the anode disk is inclined to the left with respect to the rotational plane of the rotary anode such that the focal spot position of the electron beam impinging onto the target area of the anode disk's X-ray emitting surface lies in the plane of the central X-ray fan beam.

For illustrating the claimed method, FIG. 3*b* shows a cross-sectional schematic view of the inclinedly mounted rotary anode RA from FIG. 3*a* when being depicted in the aforementioned first phase of rotation where the anode disk is inclined to the left with respect to the rotational plane of the rotary anode RA such that the focal spot position FS of the electron beam EB impinging onto the target area AT of the anode disk's X-ray emitting surface lies in the plane $P_{CXB}$ of the central X-ray fan beam. As can be seen from this figure, deviation amplitude $\Delta z$ of focal spot position FS is in this ideal case equal to zero.

Figure 3C:
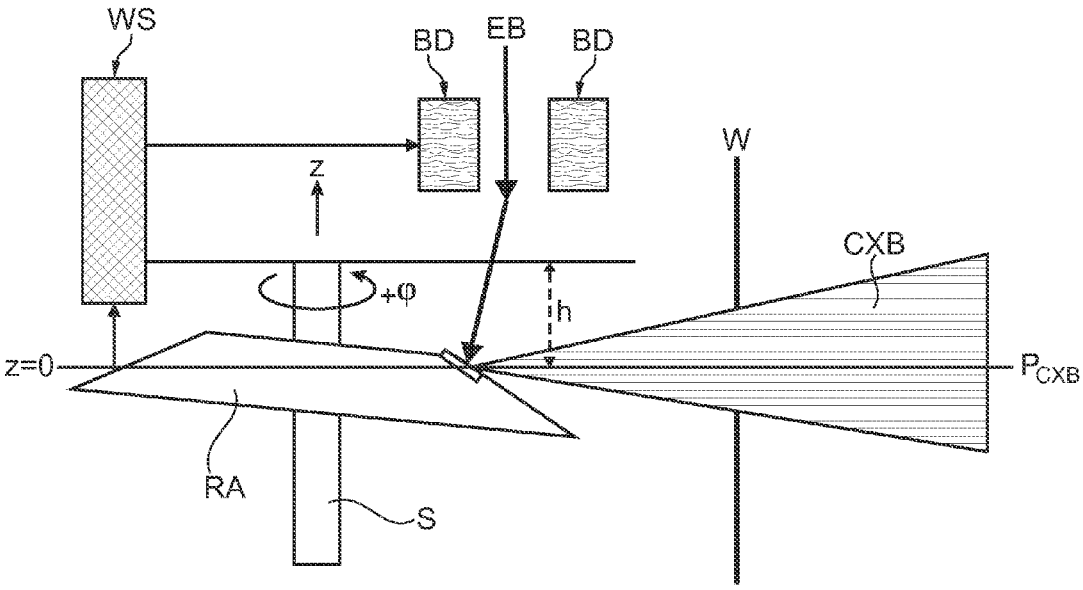
FIG. 3*c* shows a cross-sectional schematic view of the inclinedly mounted rotary anode from FIG. 3*a* depicted in the second phase of rotation, obtained after one half revolution of the rotating anode disk about the rotational axis of its rotary shaft or an odd-valued multiple thereof, which illustrates that the anode disk is inclined to the right with respect to the rotational plane of the rotary anode such that the electron beam has to be deflected to the left according to the detected output signal of a position sensor to make the focal spot position of the electron beam impinging onto the target area of the anode disk's X-ray emitting surface lie in the plane of the central X-ray fan beam.

For comparison, FIG. 3*c* shows a cross-sectional schematic view of the inclinedly mounted rotary anode RA from FIG. 3*a* depicted in the aforementioned second phase of rotation, obtained after one half revolution of the rotating anode disk about the rotational axis of its rotary shaft S or an odd-valued multiple thereof. FIG. 3*c* thereby illustrates that the anode disk is inclined to the right with respect to the rotational plane of the rotary anode RA such that the electron beam EB emitted by the tube cathode's thermoionic or other type of electron emitter has to be deflected to the left according to the detected output signal of said position sensor WS to make the focal spot position FS of the electron beam EB impinging onto the target area AT of the anode disk's X-ray emitting surface lie in the plane $P_{CXB}$ of the central X-ray fan beam CXB.

The proposed system and method thus leads to an improved power loading and accuracy of the focal spot position as well as to an enhanced image quality. On the other hand, it should be noted that the above-described compensation works accurately only in the central X-ray fan beam CXB. However, the focal spot FS is typically specified for this direction, and the most important area of the X-ray image is usually the center of it.

APPLICATIONS OF THE PRESENT INVENTION

The invention can especially be applied in X-ray tubes of the rotary anode type as used in X-ray-based medical and non-medical applications where it is necessary to generate X-ray images with an enhanced image quality as well as with an improved power loading. The invention can further advantageously be applied in those X-ray tubes of the aforementioned type where a blurring of the focal spot, which in consequence may lead to a considerable worsening of the obtained image quality, is caused by anode wobble effects and other kinds of mechanical distortions such as e.g. standing vibrations and anode disk bending.

While the present invention has been illustrated and described in detail in the drawings and in the foregoing description, such illustration and description are to be considered illustrative or exemplary and not restrictive, which means that the invention is not limited to the disclosed embodiments. Other variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality. Furthermore, it is to be noted that any reference signs in the claims should not be construed as limiting the scope of the invention.

LIST OF REFERENCE SIGNS

AB Anode body (substrate), made of a refractory metal (e.g. SiC layer)
AT Anode target, made of a refractory metal (e.g. SiC layer)
B Ball bearing
BD Beam deflection unit
C Electron emitting filament cathode
CA C-arm
CAA horizontal C-arm axis, perpendicular to propeller axis PA
CH Evacuated chamber
CS X-ray tube casing (tube envelope)
CoS Cooling system
CU Control unit
CXB Central X-ray fan beam CXB
D X-ray detector
EB Electron beam
FS Focal spot (also referring to the position thereof)
HVG High-voltage generator
IC Isocenter of the C-arm assembly
LA L-arm
LAA L-arm axis
LSH Lead shielding
M C-arm mount
MF Mechanical fixing
O Oil
OC Oil connection
P High-voltage plug
PA horizontal propeller axis
$P_{CXB}$ Plane of central X-ray fan beam CXB
PT Patient table
RA Rotary anode (here also referred to as anode disk), which comprises said anode body AB and anode target AT
RO Rotor S Rotary shaft
SO X-ray source
ST Stator
VC Vacuum
W Window
WS Position sensor
XB X-ray beam
XT X-ray tube
h Protruding height of shaft S over plane $P_{CXB}$
Δl Projected diameter of focal spot FS, perspectively foreshortened in z-direction, such as seen from a point of view which lies in the plane $P_{CXB}$ of the central X-ray beam CXB on the right side of the anode disk RA depicted in FIGS. 2*a* and 3*a*
z Axis of rotation (=symmetry axis of the rotary anode RA)
Δz Recurrent deviation (deviation amplitude) of focal spot position FS in ±z-direction owing to the wobble effect of the rotating anode disk RA
±ϕ Rotational angle (positive or negative) of the rotating anode disk RA
$\phi_0$ Given phase of rotation (with $\phi_0 \in [0°; 360°[$)
$\theta_1$ Rotational angle about the y-axis of a stationary 3D Cartesian coordinate system spanned by the orthogonal coordinate axes x, y and z
$\theta_2$ Rotational angle about the z-axis of the stationary 3D Cartesian coordinate system
x x-axis of the stationary 3D Cartesian coordinate system, indicates the direction of C-arm axis CAA
y y-axis of the stationary 3D Cartesian coordinate system, indicates the direction of L-arm axis LAA
z z-axis of the stationary 3D Cartesian coordinate system, indicates the direction of propeller axis PA

The invention claimed is:

1. A system for an X-ray tube, said tube having a cathode and a rotary anode disk, said cathode having an emitter for emitting onto said disk an electron beam having a focal spot, said system being configured for measuring and compensating a cyclically recurrent deviation of a current position of said focal spot from a target position of said focal spot, the recurrence being in synchrony with rotation of said disk, said system comprising:

a position sensor for detecting said deviation; and a beam deflection unit configured for deflecting said electron beam based on measurement results obtained from said position sensor.

2. The system according to claim 1, said deviation being representative of a periodical wobbling of an inclination angle of said disk with respect to an ideal rotational plane which is oriented normal to a rotating shaft on which said disk is inclinedly mounted, said system being configured for, via said position sensor, detecting said deviation over time.

3. The system of claim 2, said wobbling resulting from an inaccuracy during a production process.

4. An X-ray tube (XT) of the rotary-anode type, comprising a system according to claim 1.

5. The system of claim 1, said beam deflection unit comprising an integrated controller for said deflecting.

6. The system according to claim 5, wherein said integrated controller is configured to steer said electron beam such that said focal spot in a target region on an X-ray generating surface of said rotary anode disk stays within a plane of a central X-ray fan beam, said plane being substantially normal to a rotational axis of a rotating shaft in which a time-averaged position of said focal spot lies.

7. The system of claim 1, said disk having a target area, said beam being emitted onto said target area.

8. The system of claim 1, said deviation representing a difference between two values, the first value being a current distance, in an axial direction of said disk, from a reference point until impact of said beam onto said disk given a current beam trajectory, the second value being a reference distance, in said axial direction, from said point.

9. A non-transitory computer readable medium embodying a program for measuring and compensating a cyclically recurrent deviation of a current position of a focal spot, of a beam to a rotary anode to cause emission of X-rays, from a target position of said focal spot, the recurrence being in synchrony with rotation of said anode, said program having instructions executable by a processor for carrying out a plurality of acts, among said plurality there being the acts of:

during at least one cycle of said rotation, sensing a position of said anode and thereby detecting said deviation; and deflecting said beam based on the detected deviation.

10. The computer readable medium according to claim 9, said deviation being representative of a periodical wobbling of an inclination angle of said anode with respect to an ideal rotational plane which is oriented normal to a rotating shaft on which said anode is inclinedly mounted due to an inaccuracy during its production process, said detecting being of said deviation over time.

11. The computer readable medium according to claim 10, said anode having an X-ray generating surface, said surface having a target region, said rotating shaft having a rotational axis, said beam being an electron beam, said deflecting comprising steering said beam such that said focal spot in said target region stays within a plane of a central X-ray fan beam, said plane being substantially normal to said rotational axis, a time-averaged position of said focal spot lying in said plane.

12. The computer readable medium according to claim 11, said steering being such that a track of said focal spot describes an elliptical trajectory.

13. The computer readable medium according to claim 11, said steering being such that a track of said focal spot describes a predefinable trajectory so as to compensate for stand vibrations and anode disk bending effects aside from compensating for said periodical wobbling.

14. The computer readable medium according to claim 9, configured for performing said sensing, and said detecting, both during a production process of a system for performing said acts and during operation to allow for a re-calibration of said system.

15. An apparatus configured for, cyclically in synchrony with rotation of a rotary anode with respect to an anode axis, deflecting a beam to said anode to cause emission of X-rays, said deflecting so as to dynamically compensate a cyclically recurrent deviation of a position of a focal spot of said beam on said anode and, by said compensation, maintaining said focal spot at a predetermined position along an axis parallel to said anode axis, said apparatus comprising:

a position sensor for detecting a position of said anode; and a beam deflection unit for said deflecting based on measurement results obtained from the position sensor.

16. The apparatus according to claim 15, configured for using output of said position sensor to determine an amplitude of a deviation in said position of said focal spot.

17. The apparatus according to claim 16, wherein said position sensor is implemented as a capacitive sensor which provides information for the determining.

18. The apparatus according to claim 16, wherein said position sensor has an aperture slit, said sensor being implemented as a current sensor for measuring how many scattered electrons fly through said aperture slit, from which number said amplitude is then derivable.

19. The apparatus of claim 16, wherein said position sensor is implemented as an optical sensor which provides information for the determining.

20. The apparatus of claim 15, said anode being mounted on a shaft for said rotation, said rotation causing said anode to cyclically wobble.

21. The apparatus of claim 20, further comprising said anode and said shaft.

22. The apparatus of claim 15, configured for deriving, for said compensation and based on a current position of said anode, a value equal to a current distance, in an axial direction of said anode, from a reference point until impact of said beam onto said anode given a current trajectory of said beam.

23. The apparatus of claim 22, said reference point corresponding, in said axial direction, to a time-averaged position of said focal spot.

24. The apparatus of claim 15, configured for said detecting, via said position sensor, over at least one cycle of said rotation.

* * * * *